US006085682A

United States Patent [19]

McCulloh

[11] Patent Number: 6,085,682

[45] Date of Patent: *Jul. 11, 2000

[54] STRAP ASSEMBLY FOR PARASAILING

[75] Inventor: Mark McCulloh, Orlando, Fla.

[73] Assignee: Controlled Parasailing Corporation of America, Ltd., Grand Cayman Island, Virgin Islands (Br.)

[ * ] Notice: This patent is subject to a terminal disclaimer.

[21] Appl. No.: 09/167,068

[22] Filed: Oct. 6, 1998

Related U.S. Application Data

[63] Continuation-in-part of application No. 08/770,740, Dec. 19, 1996, Pat. No. 5,816,184.

[60] Provisional application No. 60/008,934, Dec. 20, 1995.

[51] Int. Cl.[7] ..... B63B 21/04

[52] U.S. Cl. ..... 114/253; 114/254; 244/155 R; 244/1 TD; 244/63

[58] Field of Search ..... 114/242, 253, 114/254; 244/151 R, 151 A, 152, 155 R, 155 A, 901, 1 TD

[56] References Cited

U.S. PATENT DOCUMENTS

| | | | |
|---|---|---|---|
| 2,825,515 | 3/1958 | Gold | 244/152 |
| 2,919,085 | 12/1959 | Horning | 244/151 R |
| 3,987,746 | 10/1976 | McCulloh | 114/254 |
| 4,738,414 | 4/1988 | McCulloh | 114/253 |
| 5,367,972 | 11/1994 | McCulloh | 114/253 |
| 5,816,184 | 10/1998 | McCulloh | 114/253 |

*Primary Examiner*—Stephen Avila
*Attorney, Agent, or Firm*—Malloy & Malloy, P.A.

[57] ABSTRACT

A parasailing assembly to suspend a rider from a parachute which is being towed by a boat, with the rider supported by one of various rider support structures, such as a body harness or a seat assembly. The parasailing assembly includes an improved connecting assembly that is structured to removably interconnect a rider support structure to the canopy of a parachute and preferably, includes two elongated straps, each having an interconnecting link disposed intermediate opposite ends thereof. Preferably, each strap of the connecting assembly has at least one end is connected to rider support structure, on opposite sides of the rider. In addition, either fixedly or removably attached to the interconnecting link is a base portion having a plurality of strap segments, each of which is connected, preferably but not necessarily in a fixed manner, to a separate grouping of riser line sets which extend up to the canopy of the parachute. As such, the plurality of riser line sets corresponding to one side of the rider are, in effect, connected together at a single fulcrum point along the length of a strap. One of the rider support structuring includes an improved aerial recliner and seat assembly, having a plurality of components which may be selectively detached from one another so as to facilitate a reduced volume packaging for shipping, and to permit expansion of the seat assembly to carry additional riders.

25 Claims, 7 Drawing Sheets

STRAP ASSEMBLY FOR PARASAILING

BACKGROUND OF THE INVENTION

This is patent application is a continuation-in-part of the patent application having Ser. No. 08/770,740 and filed on Dec. 19, 1996, which is set to issue as U.S. Pat. No. 5,816,184 on Oct. 6, 1998, which included a claim of priority under U.S.C §119(e) to a provisional patent application filed on Dec. 20, 1995 and assigned Ser. No. 60/008,934. All of these parent or prior patent applications are incorporated by reference in their entireties, as if fully set forth herein.

FIELD OF THE INVENTION

The present invention is directed to a parasailing assembly comprising a rider support structure and a connecting assembly. More in particular, the present invention is directed to an improved connecting assembly which serves to removably attach the canopy and riser lines of a conventional parachute used in parasailing operations to the rider support structure, which may be either in the form of a body harness or a buoyant seat assembly. In addition, the present invention is directed to an improved rider support structure in the form of a buoyant seat assembly which is structured to be selectively assembled or disassembled so as to facilitate packaging and shipping.

DESCRIPTION OF THE RELATED ART

The sport of parasailing is relatively new but has greatly increased in popularity over the last several years. As a result, the sport of parasailing has seen relatively few equipment innovations which would render the sport both safer and more enjoyable and thereby enlarge the age group of potential participants. For example, in the past, parasailing enthusiasts have frequently used equipment designed for other sports, such as water skiing, sky-diving, hang-gliding, etc. which, as in this sport, essentially involve the launching and retrieving of a participant. It is true that the activity of parasailing, like these related sports, carries a certain amount of risk of injury. However, the lack of equipment properly directed to parasailing activities, as well as the existence of relatively few trained personnel, is thought to have aggravated this risk, and may have even contributed to injuries incurred during parasailing operations.

For example, a very common type of equipment used in parasailing is a harness structure that is attached to the body of the parasailor and that is supported directly from the "riser lines" which normally serve to interconnect the canopy of the parachute to the harness structure worn by the parasailor. When utilizing such a harness structure, the parasailor is maintained in a substantially upright orientation prior to and during launching, and a standing or partially sitting position during parasailing. While this type of structure provides adequate support during parasailing, it is believed to still be lacking significant safety features. For instance, the body harness structure used to support a parasailor from a parachute is usually of the type which closely resembles the body harness used in the sport of sky-diving. The sport of sky-diving, however, is geared solely to land-based take-offs and landings, whereas the flight operation of parasailing takes place almost entirely over water, with water landings and take-offs being possible. Although such harness structures are common, even during contemporary times, they carry a degree of risk for indirectly causing injury to the parasailor, due to any number of unknown events. Similarly, the body of the parasailor is exposed in a harness structure, meaning that if an emergency or abrupt water landing were to occur, such as might be caused by breakage of the tow line or failure of the tow boat, the body of the parasailor is likely to absorb most of the impact. As such, it is believed that these harness structures, although able to fulfill basic parasailing needs in good, clear weather and related conditions, are not preferred equipment. However, other factors can come into play during a parasailing operation, and need to be addressed if it is to become a much safer operation and thereby, become both attractive and available to a larger group of people, including but not limited to children, the elderly and those who are overweight or handicapped.

As demonstrated in my patented inventions in U.S. Pat. No. 3,987,746; No. 4,738,414 and No. 5,367,392, I have endeavored over the last several years to innovate "cutting edge" parasailing equipment which serves to reduce the safety hazards associated with parasailing, and in general, to make parasailing more safe and comfortable, as well as less threatening to those who would otherwise participate. For example, my U.S. Pat. No. 4,738,414, incorporated herein by reference, is directed towards innovative parasailing equipment associated with efficiently and more safely launching and retrieving a parasailor, and also, towards a rider support structure which maintains the parasailor in a somewhat seated and reclined position within a buoyant structure so as to offer protection, should there inadvertently be a landing on water. However, even in light of the improvements set forth in my above noted patents, there remains a need in the parasailing industry for both an improved buoyant rider support structure, and importantly, an improved connecting assembly which would serve to interconnect the parasailor's rider support structure with the canopy and riser lines of the parachute.

More in particular, one problem arises in parasailing operations which is presented by the traditional manner in which the parachute riser lines are attached to the rider support serving to retain the parasailor. Specifically, there are generally three distinct groupings of parachute riser lines which are disposed on the right side of the parasailor and an additional three distinct groupings of parachute riser lines which are disposed on the left side of the parasailor. Typically, these riser lines are attached as follows. The first, forward most set of riser lines on each side are referred to as the "top" riser lines and are attached to a towing rope for towing by the boat. The second, center set of riser lines on each side are referred to as the "apex" riser lines and are often attached to the canopy at the highest point thereon. However, occasionally this "apex" set of riser lines may be left unattached. A third, rearmost set of riser lines or "bottom" riser lines, are attached to the parasailor—such as to a body harness structure worn by the parasailor. This standard arrangement of attaching parachute riser lines yields several pulling points, and this can and often does result in unexpected directional changes of the parachute and parasailor during flight. Specifically, depending upon whether the parasailor makes certain movements, the experience of the tow boat driver, and even wind conditions, it is possible for the parachute to ascend, descend, or to move from one side to the other (oscillate) and/or to perform any of these movements, suddenly and unexpectedly. This unpredictable shifting ability in the attitude of the parachute carries the potential of severely unstable and frightening flight conditions.

As one example, when the tow boat accelerates, the motion is transferred to the tow rope which will also move forward, and which in turn, will move the top riser lines forward. Forward movement of the top riser lines will increase the pitch of the top of the parachute canopy, which provides increased lift. With respect to take-offs made from the land, this increased lift has the benefit of reducing the travel distance a parasailor standing on a beach would have to physically run in order to accomplish flight or ascension. However, this increased pitch of the top riser lines is also now believed by the inventor hereof to potentially result in instability during flight. For instance, if there should be an inexperienced boat driver, he or she might inadvertently accelerate suddenly and/or unexpectedly and cause this same pitching of the parachute during flight, and thereby result in a sudden, rapid ascension of the parachute. As another example, the conventional positioning of the riser lines are such that a parasailor riding within and retained by a body harness structure can reach the riser lines, and can negatively influence the flight of the canopy by pulling on the top riser lines, and thereby, cause sudden shifting, ascension, descencion or oscillation of the parachute. Finally, the conventional arrangement of riser lines are also susceptible to sudden wind gusts and/or changes in wind direction causing unexpected and abrupt changes in the parachute canopy's attitude and stability while in flight, all of which carry the potential for severely unstable flight conditions.

Accordingly, there remains an appreciable need in the parasailing industry for improved parasailing equipment which overcomes the disadvantages and safety hazards that are still present during many parasailing operations throughout the world. Any such improved parasailing equipment should have the goal of providing a more stable and predictable ride during flight, as well as an efficient and comfortable take-off during launching with improved lifting performance. In addition, any such improved parasailing equipment should make it difficult, if not impossible, for the parasailor to reach or otherwise manipulate the parachute canopy while in flight, particularly when a body harness structure is utilized. Any such parasailing equipment should reduce, if not eliminate, unexpected directional changes of the parachute and parasailor during flight, and should also, during either flight or launching be able to resist the forces of higher wind gusts which frequently reach about 15 miles per hour or somewhat greater. Any such parasailing equipment should also be able to reduce, if not eliminate, unexpected directional changes of the parachute, even when other de-stabilizing forces are exerted on the parasailing assembly, such as but not limited to an uneven passenger load or other factors that might cause excessive rolling or other movement of the canopy during flight.

In addition to the foregoing, it would be helpful if a buoyant rider support structure could be designed that not only surrounds the rider during a parasailing operation and addresses the various other important safety factors, but that is capable of facilitating both the packaging and shipping of the structure. Because the sport of parasailing has been steadily increasing, the distribution of parasailing equipment throughout most industrialized countries of the world has also increased. However, the cost of shipping has discouraged the widespread distribution of fixed, rather bulky, rider support structures in the form of an aerial recliner, as was disclosed in my previous patent application. As such, it would be ideal if a rider support structure in the form of an aerial reclining seat assembly for one or more riders was developed which was capable of being selectively assembled or disassembled in an easy and efficient manner so as to achieve a reduced volume which is convenient for packaging and shipping to distant locales. In addition, it would be ideal if any such rider support structure was capable of being selectively assembled or disassembled and/or interchanged with certain structural components associated therewith, so as to be expandable and contractible, so as to offer versatility, in terms of being able to carry a larger or smaller number of passengers. The increase in passenger capacity of any such rider support structure at any given site is of significant interest to the operators of a parasailing facility, in order to increase revenue and have greater marketing appeal to parents, families, and the like. The present invention is designed to satisfy these and other long felt needs in the parasailing industry, and is believed to represent a significant advance, particularly in the area of safety and rider comfort, for parasailing enthusiasts.

SUMMARY OF THE INVENTION

The present invention is directed towards a new and improved parasailing assembly designed to provide for a more stable, and therefore, safer flight during a parasailing operation. The parasailing assembly of the present invention is intended for use by one or more parasailors who may choose to be carried by a rider support structure comprising either an inventive seat assembly or a conventional body harness structure. The inventive seat assembly is structured to retain one or more riders in a substantially reclined orientation and, as set forth in greater detailed hereinafter, is formed in part from a buoyant material or float structure which protects the one or more riders by maintaining them in a floating orientation on the surface of body of water in an unusual or emergency conditions.

In addition, the parasailing assembly of the present invention is directed to an inventive connecting assembly that is designed and structured to supportingly interconnect the rider support structure, and the one or more parasailors carried thereby, to the parachute for the various stages of a parasailing operation, regardless of whether a body harness structure or an inventive seat assembly is chosen as the rider support structure. Preferably, the connecting assembly comprises two elongated straps, each terminating at opposites ends, and with a connector structure mounted at each opposite end. The connecting assembly further includes an interconnecting link disposed and/or formed on each elongate strap intermediate the opposite ends thereof, and ideally, at generally about, but not necessarily precisely, a mid-portion thereof. In a preferred embodiment, each interconnecting link also includes a base portion, and secured to the base portion and extending therefrom are a plurality of strap segments, each of which is removably or fixedly attached to a segregated grouping of riser lines. Thus, each of the plurality of riser lines on one side of the parasail rider are preferably connected indirectly to one another at a common location or area by way of the base portion, as is also preferably true for each of the plurality of riser lines on the opposite side of the parasail rider. That is, because the base portion is either directly or indirectly secured to the interconnecting link, only a single fulcrum point is defined along the length of each of the straps, regardless of the type of rider support structure chosen. The existence of one fulcrum point on each of the two straps, as set forth above, is believed to result in inherently more stability during the launching, flight and retrieval stages of the parasailing operation. As has been described, the connecting assembly of the present invention is capable of being utilized with either a body harness or a seat assembly type of rider support structure, and as will become more clear from the detailed description of the invention, below, in either embodiment, the positioning of the riser lines and of the tow line in their attachment to either a seat assembly or a body harness structure, makes it more difficult, if not impossible, for the parasailor to manipulate the riser lines extending up to the parachute canopy while in flight, whether by physically contacting the riser lines themselves or engaging any portion of the equipment which would be likely to control the riser lines. By virtue of the above, the present invention offers increased stability during the various stages of a parasailing operation, including improved lifting performance during ascent and launching.

Therefore, it is a primary object of the present invention to provide a parasailing assembly having an improved connecting assembly which is interchangeable with different types of rider support structures for the purpose of connecting the selected rider support structure to the canopy and/or riser lines of a parachute, while at the same time, assuring safer performance during the various stages of a parasailing operation and under other various conditions, and regardless of the type of rider support structure which is utilized.

It is another primary object of the present invention to provide a parasailing assembly having an improved connecting assembly that is capable of being removably attached to either the commonly used, body harness type of rider support structure or alternatively, to an inventive rider support structure comprised of an aerial recliner and seat assembly which is capable of retaining one or more riders concurrently thereon.

Yet another primary object of the present invention is to provide an improved parasailing assembly which is inherently more safe than other parasailing assemblies by providing a connecting assembly that reduces unexpected directional changes of the parachute during flight and offers a smoother, more comfortable ride during all stages of the parasailing operation.

Another primary object of the present invention is to provide and improved parasailing assembly which more evenly distributes the weight of an occupied rider support structure, in the form of a seat assembly, during the launch stage of parasailing, thereby resulting in an assembly which is resistent to wind gusts as well as other de-stabilizing forces such as might occur because of unbalanced passenger load, uneven or unnecessary acceleration of the towing boat or unpredictable weather conditions.

It is also an important object of the present invention to provide a parasailing assembly having an improved rider support structure in the form of an aerial recliner and seat assembly, which can be readily assembled or disassembled in order to facilitate packaging, such as by offering a reduced volume to be packaged, and thereby, to facilitate shipping and achieve a reduction in costs associated with shipment.

It is also an important object of the present invention to provide a parasailing assembly having an improved rider support structure in the form of an aerial recliner and seat assembly, which can be easily disassembled and reassembled for purposes of changing the dimension of certain structural components thereof, and to thereby, increase the number of passengers to be carried by the aerial recliner and seat assembly during a parasailing operation.

Yet another object of the present invention is to provide a parasailing assembly having an improved rider support structure in the form of an aerial recliner and seat assembly, which is floatable, and therefore, which is unlikely to capsize in the event of a water landing, instead of being returned to an intended launching platform, regardless of adverse weather or choppy water conditions.

It is also an object of the present invention to provide a parasailing assembly which maintains one or more riders in a generally reclined position and which is highly comfortable to the riders throughout the flight of the parasailing operation.

These and other objects, features and advantages of the present invention will become more clear when the detailed description which follows, along with drawings, are taken into consideration.

BRIEF DESCRIPTION OF THE DRAWINGS

For a fuller understanding of the nature of the present invention, reference should be had to the following detailed description, taken in connection with the accompanying drawings, in which:

FIG. 12A is an isolated magnified view of certain preferred components of FIG. 12.

Like reference numerals refer to like parts throughout the several views of the drawings.

DETAILED DESCRIPTION OF THE PREFERRED EMBODIMENT

The present invention is directed towards an improved parasailing assembly, and is disclosed in detail throughout the FIGS. 1–14.

Figure 1:
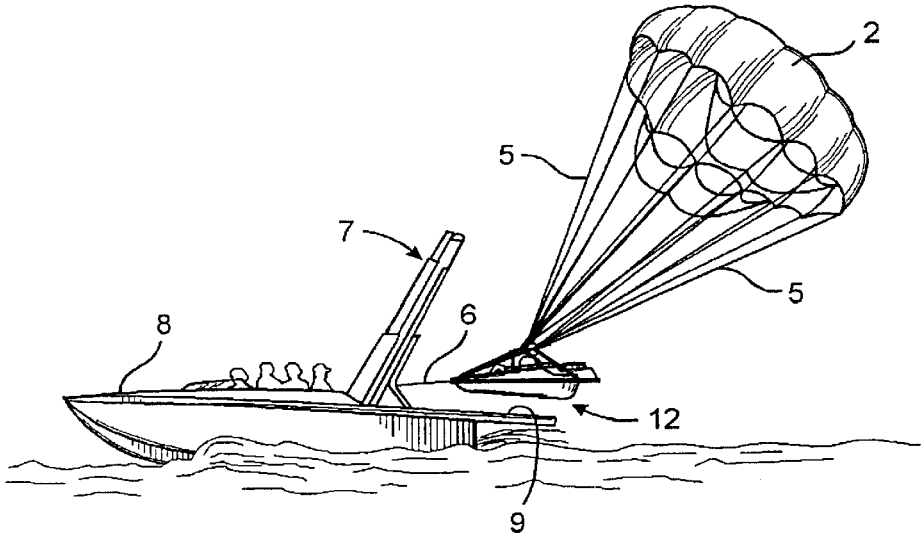
FIG. 1 is a perspective side view of the parasailing assembly of the present invention and illustrating one embodiment of the rider support structure as it is being moved into a launched orientation.

With initial reference to FIG. 1, the parasailing assembly of the present invention can be seen to include a parachute canopy, 2, which may be of a conventional parachute structure, but which is not necessarily limited thereto, and further, a plurality of riser lines, 5, which serve to support and interconnect the parachute canopy, 2, to one of various types of rider support structures during a parasailing operation. FIG. 1 illustrates a rider support structure in the form of a seat assembly 12, which is deemed preferable for several reasons, although as will be described in greater detail hereinafter, the present invention is intended to be readily interchanged for use with other rider support structures. Still referring to FIG. 1, the seat assembly 12 is capable of supporting one or more riders in a substantially reclined orientation, and further, is typically intended to be launched from a platform, 9, attached to the stern or rear portion of a boat, 8, when the canopy, 2, fills with air and becomes inflated due to the existence of wind primarily caused by the rapid forward motion of the tow boat 8. The term "inflated" as used herein relative to the suspension of the canopy 2 of the parachute assembly does not, in fact, mean that the canopy or other portions of the parachute assembly contain inflatable portions, but rather, that the canopy 2 is expanded and suspended by the on-rushing wind due to the travel of the tow boat 8. From the accompanying Figures, it should be appreciated that in the assembled form and during a launched orientation, when the canopy 2 is filled with air, the seat assembly 12 is disposed in depending, supported relation from the canopy 2. It should also be appreciated that in use, the seat assembly 12 or other rider support structure will preferably cooperate with the tow boat, 8, by means of a tow line, 6, connected directly or indirectly thereto. In modern day parasailing operations, it is common to include a launching assembly, 7, such as of the type which I have previously invented, in the form of a retractable and expandable mast, and the launching platform, 9, mounted on the tow boat 8, so that the tow line 6 may extend outwardly from a power winch 13, shown in FIG. 2, preferably through a line guide assembly 15, also shown in FIG. 2. Thus, when it is desired to retrieve a seat assembly 12 or a parasailor supported by another type of rider support structure, such as a body harness, 18, illustrated in FIGS. 2 and 5 through 8, the tow line 6 is wound back onto the power winch 13 through the aforementioned line guide assembly 15.

Figure 2:
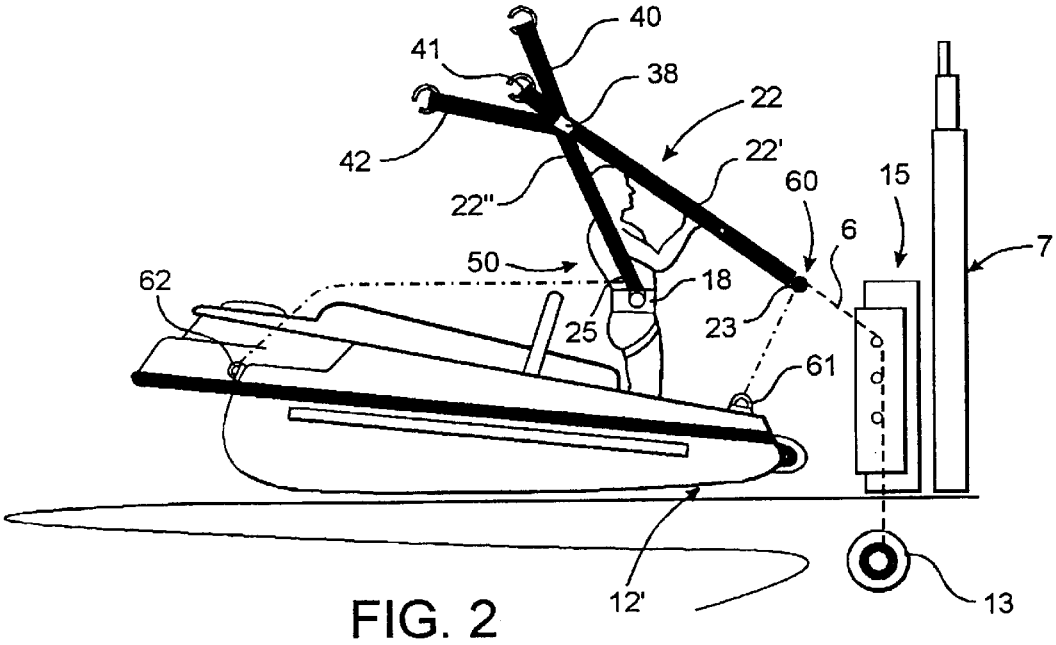
FIG. 2 is a reverse side view which illustrates the inventive connecting assembly according to the present invention being removed from the rider support structure depicted in FIG. 1 and being interconnected instead with a second embodiment of rider support structure, namely, a body harness structure.
Figure 3:
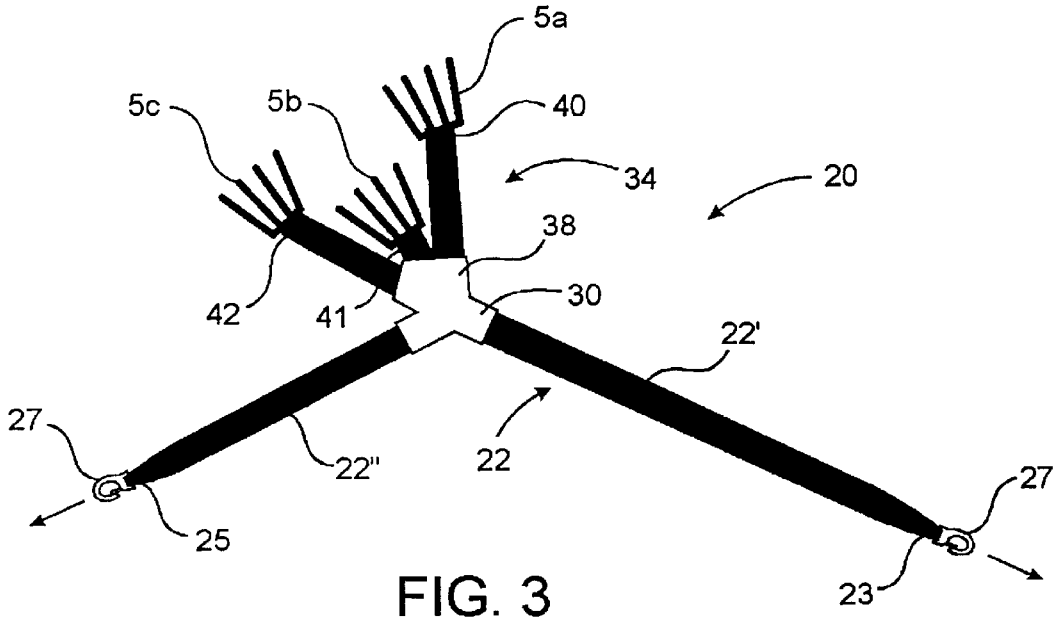
FIG. 3 is a detailed view of the inventive connecting assembly of the present invention in a first embodiment wherein the components thereof are fixedly secured to one another.
Figure 11:
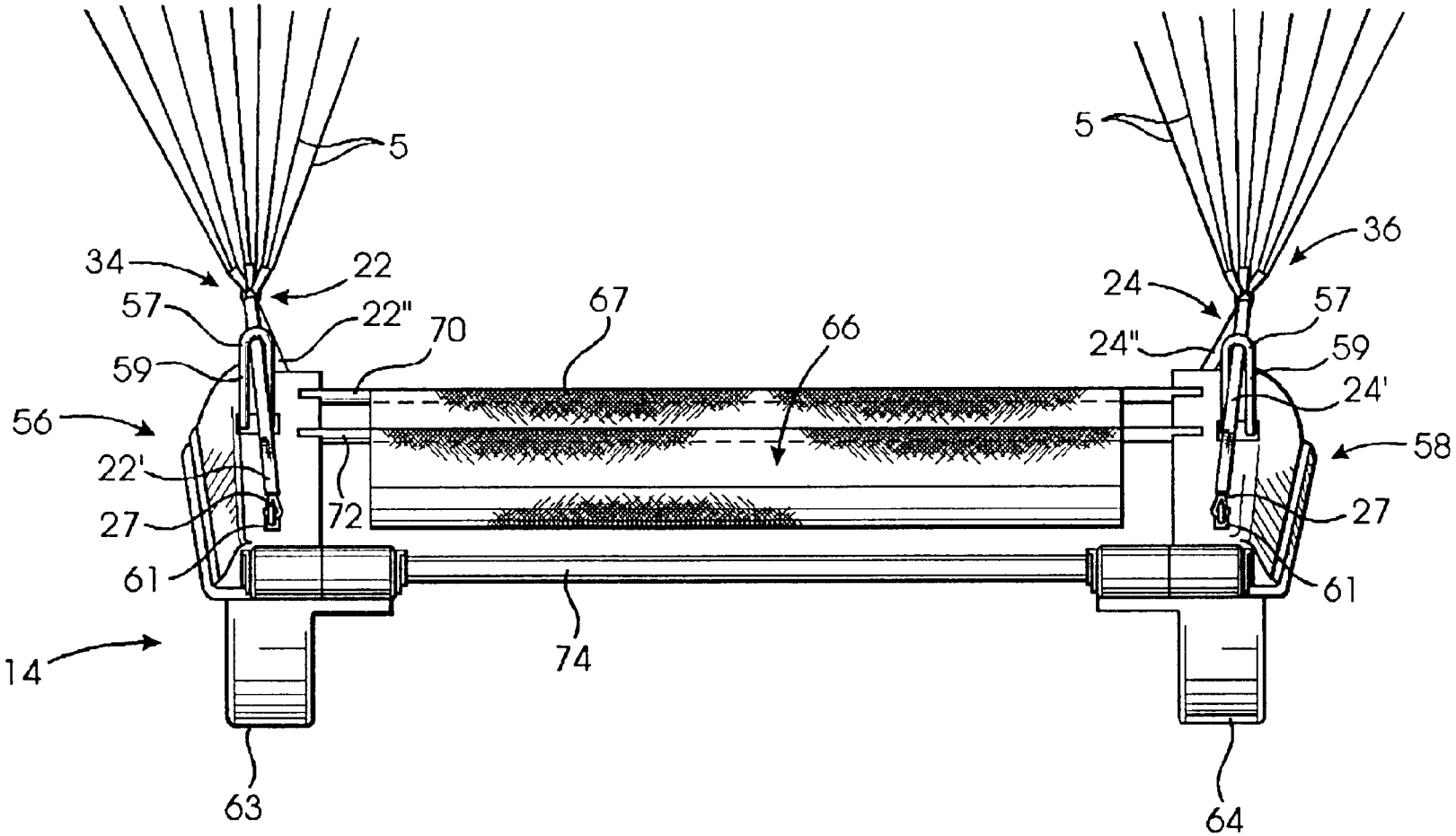
FIG. 11 is a front view in schematic and partial cutaway of a portion of the inventive rider support structure illustrated in FIG. 10.

The parasailing assembly of the present invention is primarily directed to an inventive connecting assembly, indicated generally by reference numeral 20, that is designed and structured to supportingly interconnect the rider support structure, such as 12, and the one or more parasailors carried thereby, to the parachute for the various stages of a parasailing operation, regardless of the rider support structure being utilized. The connecting assembly 20 preferably comprises a pair of elongated straps, 22 and 24, each of which has what may be referred to as a leading portion 22', 24' and a trailing portion 22", 24", respectively. Further, each of the straps, such as 22, terminate at oppositely disposed ends, 23 and 25, and as shown in FIG. 2, preferably define a forward end and an aft end, respectively. A connector structure such as coupling members, 27, may be attached to each of the ends, 23, 25 of each strap in order to facilitate the removable connection of the strap to the rider support structure which is selected for a parasailing operation. For purposes of clarity, the structural details of the connecting assembly 20 will be described in detail with reference to a single strap 22, such as is shown in FIG. 3. As is best illustrated in FIG. 11, however, the connecting assembly 20 will comprise in a most preferred embodiment, at least two separate and elongated straps, which serve to interconnect a rider support structure, such as 12 or 18, to the riser lines 5 of the parachute canopy 2. In addition, in the most preferred embodiment, each of the elongated straps 22 and 24 are mounted on and removably connected to opposite sides of the rider support structure 12, as will also be explained in greater detail hereinafter. It should be emphasized at this juncture, however, that it would be within the scope and spirit of the present invention to connect together more than just two straps or even a single strap in a manner designed to achieve the same effect offered by the preferred pair of elongated straps 22 and 24.

Figure 4:
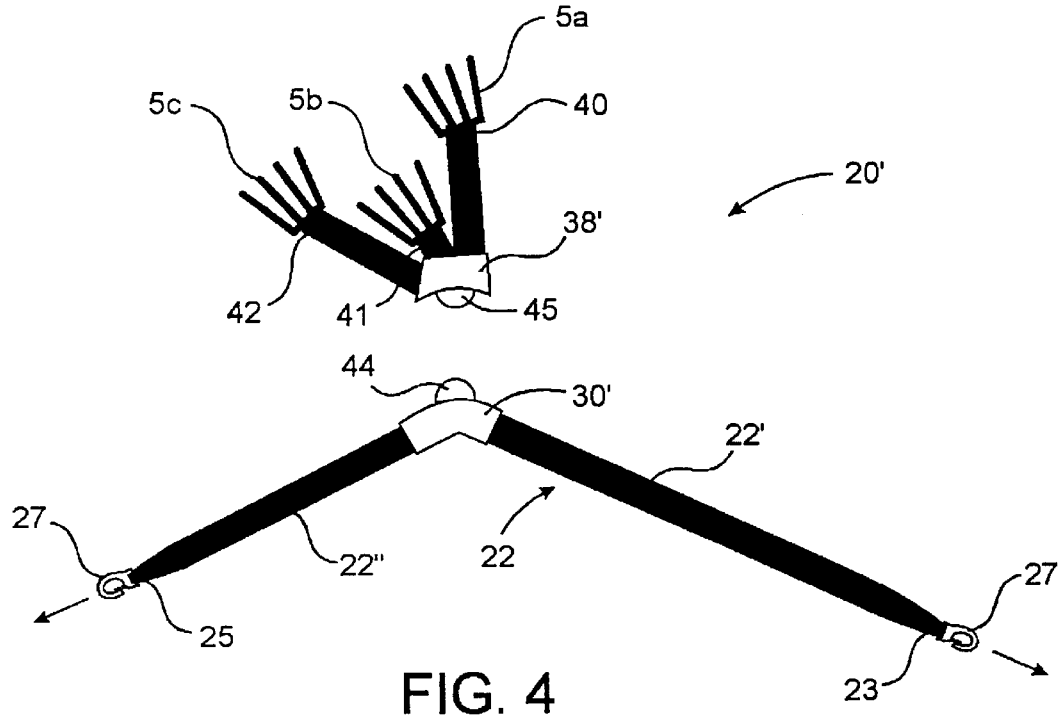
FIG. 4 is a detailed view of the inventive connecting assembly of the present invention, in an embodiment similar to that shown in FIG. 3, but with components thereof being removably attachable to one another.

As has been described, then, the connecting assembly 20 preferably includes two elongated straps, 22 and 24, wherein each of the straps includes a leading portion 22', 24' and a trailing portion 22", 24", respectively. With reference now to FIGS. 3 and 4, the preferred connecting assembly 20 further comprises an interconnecting link, generally indicated by reference numeral 30, which is mounted, affixed or otherwise securely connected and/or operably coupled to each of the elongated straps 22 and 24, intermediate the opposite ends 23 and 25 thereof. Most preferably, the interconnecting link 30 is formed on each strap 22, 24 at generally a mid-point on and central region of the elongated strap, but not necessarily at an exact mid-point or dead-center thereof. As illustrated in FIGS. 3 and 4, the connecting assembly 20 preferably also includes a plurality of strap segments, such as 40, 41 and 42, for purposes which will be described in greater detail hereinafter, that are either directly or indirectly attached to the interconnecting link 30 in a secure fashion, which might include removable attachment, if desired. With respect to FIG. 3, the interconnecting link 30 additionally comprises a base portion, 38, from which each of the strap segments 40, 41 and 42, preferably extends. With respect to FIG. 4, the interconnecting link 30' and the base portion 38' are illustrated to show that they may be removably connected to one another by means of conventional connectors in the form of D-rings or the like, as indicated at 44 and 45.

The connecting assembly 20 of the present invention is intended to be interconnected with the riser lines 5 which are usually part of the parachute and extend downwardly from the parachute canopy 2. In general, these riser lines, 5, will include a first plurality of riser lines, as indicated by reference numeral 34 in FIG. 11, and a second plurality of riser lines, 36, each of which are designed to correspond to one side, such as the left or right side of the rider support structure which is utilized, such as 12 or 18, and which will be fixedly or removably interconnected with a different one of the elongated straps 22 and 24, as will now be described. More in particular, each of the strap segments 40, 41, and 42 of the preferred connecting assembly 20, are connected either directly or indirectly, with the first or second segregated group of riser lines, such as indicated by 5A, 5B and 5C. Specifically, each of the riser lines in the first plurality 34 and second plurality 36, have been grouped into a first, forward most set of riser lines 5A (top riser lines); a second, center set of riser lines 5B (apex riser lines); and a third rearmost set of riser lines 5C (bottom riser lines), which may be contrasted with FIGS. 5, 6, and 7 which illustrate a conventional arrangement for the connection of parasailing riser lines 5 from the canopy 2 to a body harness structure 18 for a parasailor. However, a more inventive feature of the present invention, which is believed to greatly increase the stability of the rider support structure, such as 18 or 12, during a parasailing operation, is the connecting assembly 20, whereby the segregated sets of riser lines, 5A, 5B, and 5C are connected respectively to one of the strap segments, 40, 41, and 42 and accordingly, are in effect interconnected with the rider support structure at a common point of attachment, preferably defined by the base portion 38 and interconnecting link 30. In either embodiment illustrated in FIGS. 3 and 4, the base portion 38 and interconnecting link 30 establish a single fulcrum point along the length of the elongated strap 22 or 24, and it has been learned, this results in greater stability of the overall parasailing assembly, for a variety of reasons.

Figure 5:
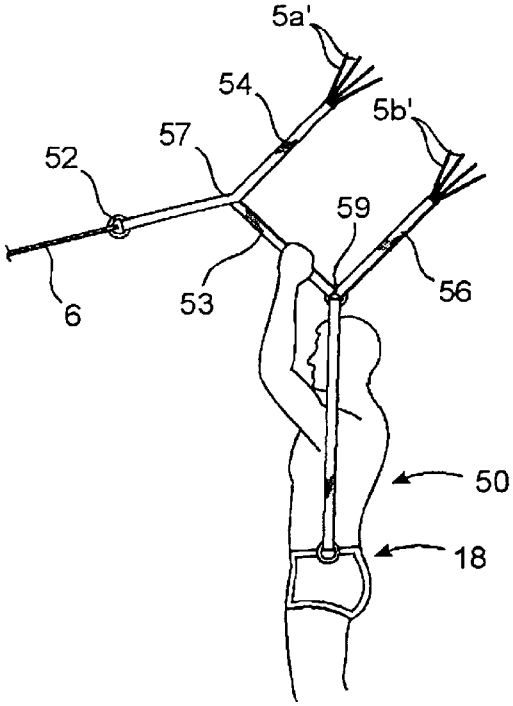
FIGS. 5 and 6 are schematic representations of industry standard equipment intended for a rider support structure in the form of a body harness, pictured respectively, in the flight mode and the pre-launch mode of a parasailing operation.
Figure 6:
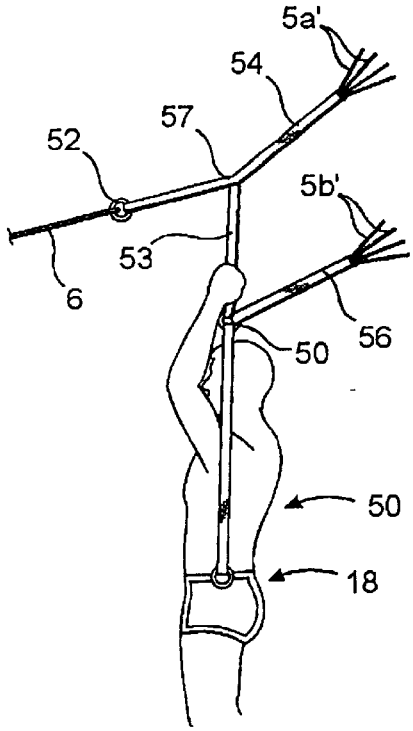
Figure 7:
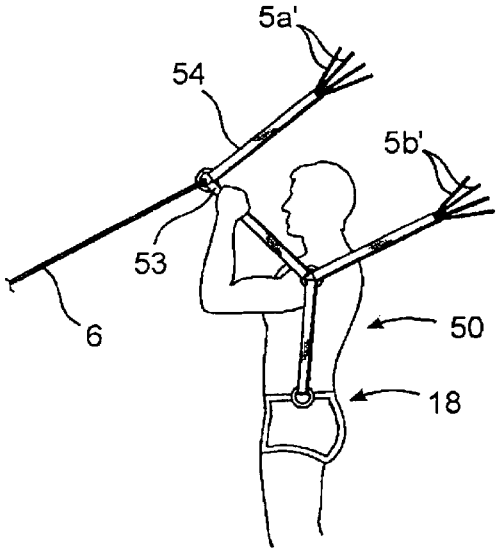
FIG. 7 is a schematic representation showing in more detail the industry standard equipment, including a rider support structure in the form of a body harness structure.

With regard to FIGS. 5 through 8, the importance of having a connecting assembly, such as 20, is to establish a single fulcrum point, such as is defined by base portion 38 (See FIG. 8) along the length of the respective straps 22 and 24, as will now be described. FIGS. 5 and 6 are intended to illustrate a conventional connecting assembly which is typically used to attach a plurality of riser lines to a rider support structure, in this case, a body harness structure 18. It is pointed out in FIGS. 5 through 7, that the plurality of riser lines are grouped into only two sets (with there being a mirror image of this on the rider's other side), indicated by reference numbers 5*a*' and 5*b*', and that the rider, generally indicated at 50, is shown as wearing a somewhat conventional body harness 18, as best shown in FIG. 7. This conventional connecting assembly includes a tow line, 6, secured to one end of a strap or like member, 52, and a plurality of strap segments, 54 and 56, attached at spaced-apart locations to the strap 52. The result is the creation of a plurality of fulcrum points, 57 and 59, which has been learned to lead to potentially disturbing instability during the parasailing flight operation, apparently because the tow line 6 is, in essence, connected directly to the strap segment 54, which in turn is connected directly to the top forward most grouping of riser lines, indicated as 5*a*' in FIGS. 5, 6 and 7. Therefore, a pulling force exerted on the tow line 6 because of an increased acceleration of the towing boat, for example, will also result in an increased pulling force exerted on strap segment 54 and top riser lines 5A'. As a result, there will be an increased tendency to have the canopy pitch or move forward during such periods of increased acceleration. Such increased pitch of the front of the canopy may have some benefit in terms of increased lift during land-based launchings when using the industry standard assembly of FIGS. 5, 6 and 7. However, such increased pitch during flight (See FIGS. 6 and 7) due to a sudden acceleration and the resulting increased forward pull on tow line 6, strap segment 54 and top riser lines 5*a*' could very well result in severe flight instability due to the "multi-fulcrum" structure of the standard parasail assembly of FIGS. 5–7. In addition, the rider 50 of FIGS. 5–7 is afforded clear access to the riser lines 5*a*' in that he may grip or control an area of the elongated strap or straps, as at 53, generally adjacent to the strap segment 54 serving to interconnect top riser line 5A' with strap 53.

Figure 8:
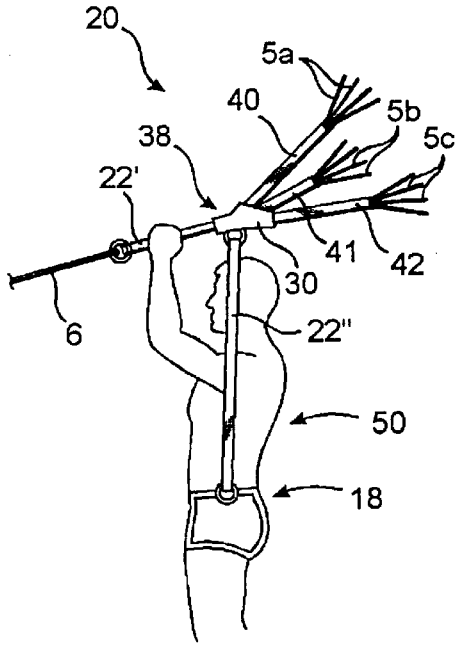
FIG. 8 is a schematic representation of the inventive connecting assembly of the present invention, attached to a rider support structure in the form of a body harness worn by a rider, in the flight mode of a parasailing operation.

To the contrary, and as shown in FIG. 8, the connecting assembly 20 of the present invention provides a single fulcrum point on each side of the rider, even when used in combination with a rider support structure in the form of a body harness, 18. In this application, the single elongated strap 22, (and strap 24, not shown, with respect to the other side of the rider) has a leading portion 22' thereof connected directly to the tow line 6, such that the top grouping of riser lines, 5*a*, are not directly influenced by the pull of the tow boat 8 and tow line 6 on the connecting assembly 20. The trailing portion 22" of the connecting assembly 20 is seen to be attached directly to the harness 18 of the rider 50, and further, with the strap segments 40, 41, and 42 effectively segregated from the pulling force being exerted by the tow boat on tow line 6. In addition, the strap segments 40, 41, and 42 will generally be out of the reach of the rider 50, so that he may not manipulate or otherwise exert some type of controlling force thereon or the riser lines attached thereto.

As shown in FIG. 2, an inventive feature of the present invention is that the connecting assembly 20 may be operatively attached in supporting relation to various rider support structures, including a body harness 18 or an aerial recliner and seat assembly. With respect to the preferred connecting assembly comprising a pair of elongated straps 22 and 24, the assembly may be changed from being set up for use on a seat assembly, 12, to being set up for use with a body harness, 18, as follows. The opposite ends 23 and 25 of each strap may first be detached for instance, from an aerial recliner and seat assembly, such as 12, which may be accomplished by the provision of the removable snap or hook type of coupling 27 secured to each of the opposite ends. More specifically, with respect to a seat assembly 12', the opposite ends 23 and 25 may be attached through eyelets or like type of couplings 61 and 62 formed on the seat assembly 12. Alternatively, when a rider 50 is using a body harness 18, each of the leading ends 22' and 24' of the two straps 22 and 24, respectively, are secured together with the tow line 6, at a common location, such as 60, and the trailing ends 22" and 24" of the straps 22 and 24 are secured to opposite sides of the harness 18 which is mounted on the rider 50. As illustrated in FIG. 2 and in FIGS. 9 through 16, it should now be apparent that the connecting assembly of the present invention is readily used with a rider support structure, such as 12, which may take the form of an aerial recliner and seat assembly as has been described in my previous application for a patent. Alternatively, the rider support structure may take the form of yet another preferred embodiment for an aerial recliner and seat assembly, as will now be described, with reference to FIGS. 9 through 14.

Figure 9:
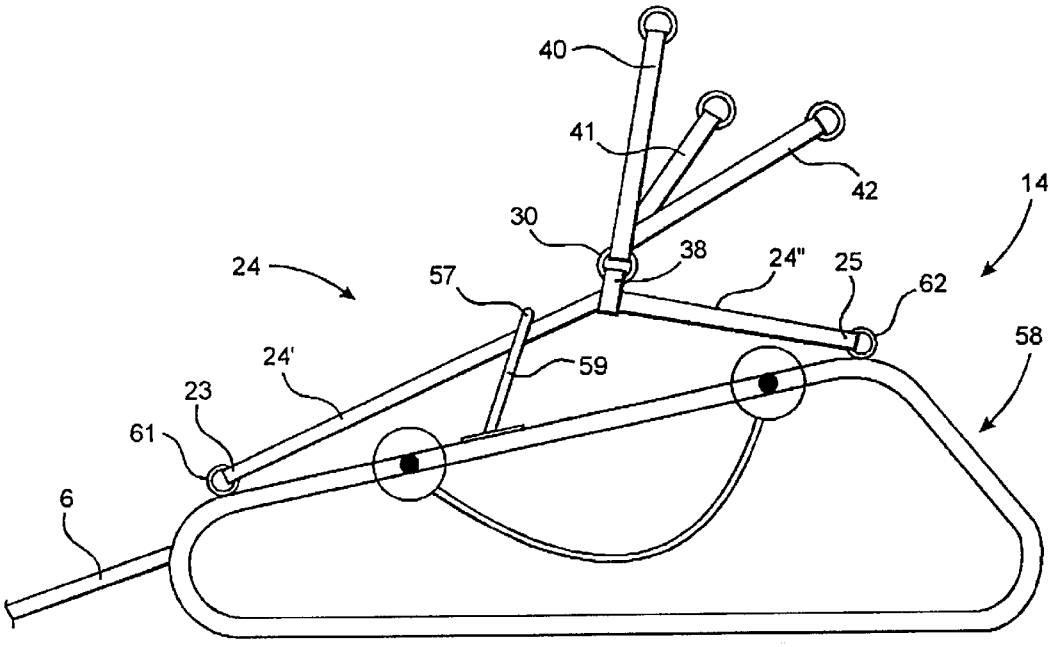
FIG. 9 is a schematic representation of the inventive connecting assembly of the present invention attached to a rider support structure in the form of an aerial recliner seat assembly, also in accordance with the present invention.
Figure 10:
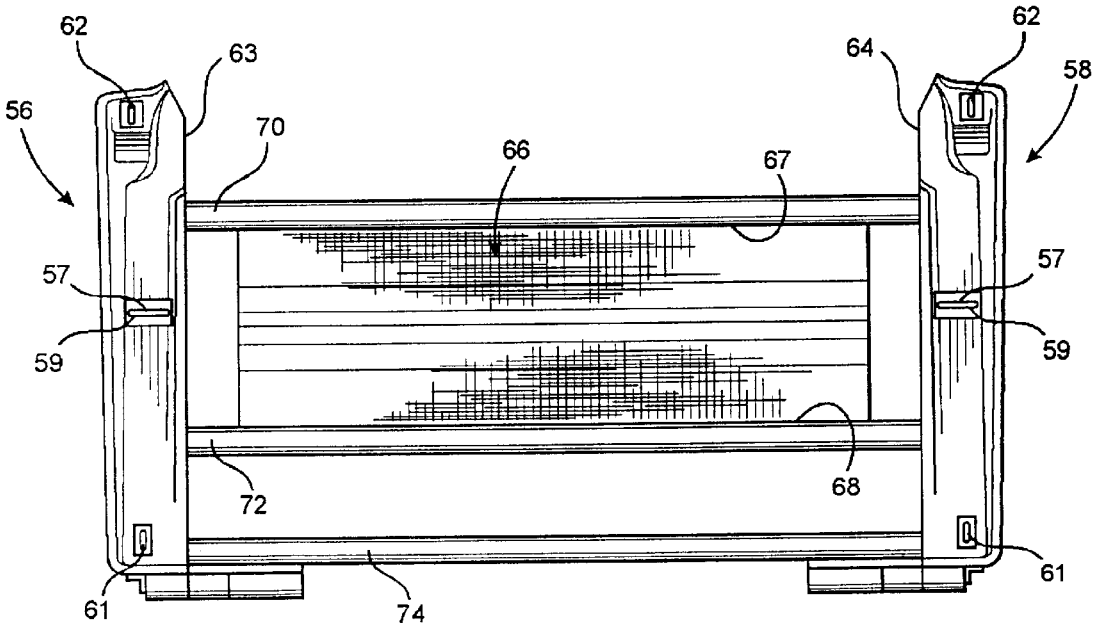
FIG. 10 is a top view in schematic form of a portion of the inventive rider support structure illustrated in FIG. 9.
Figure 12:
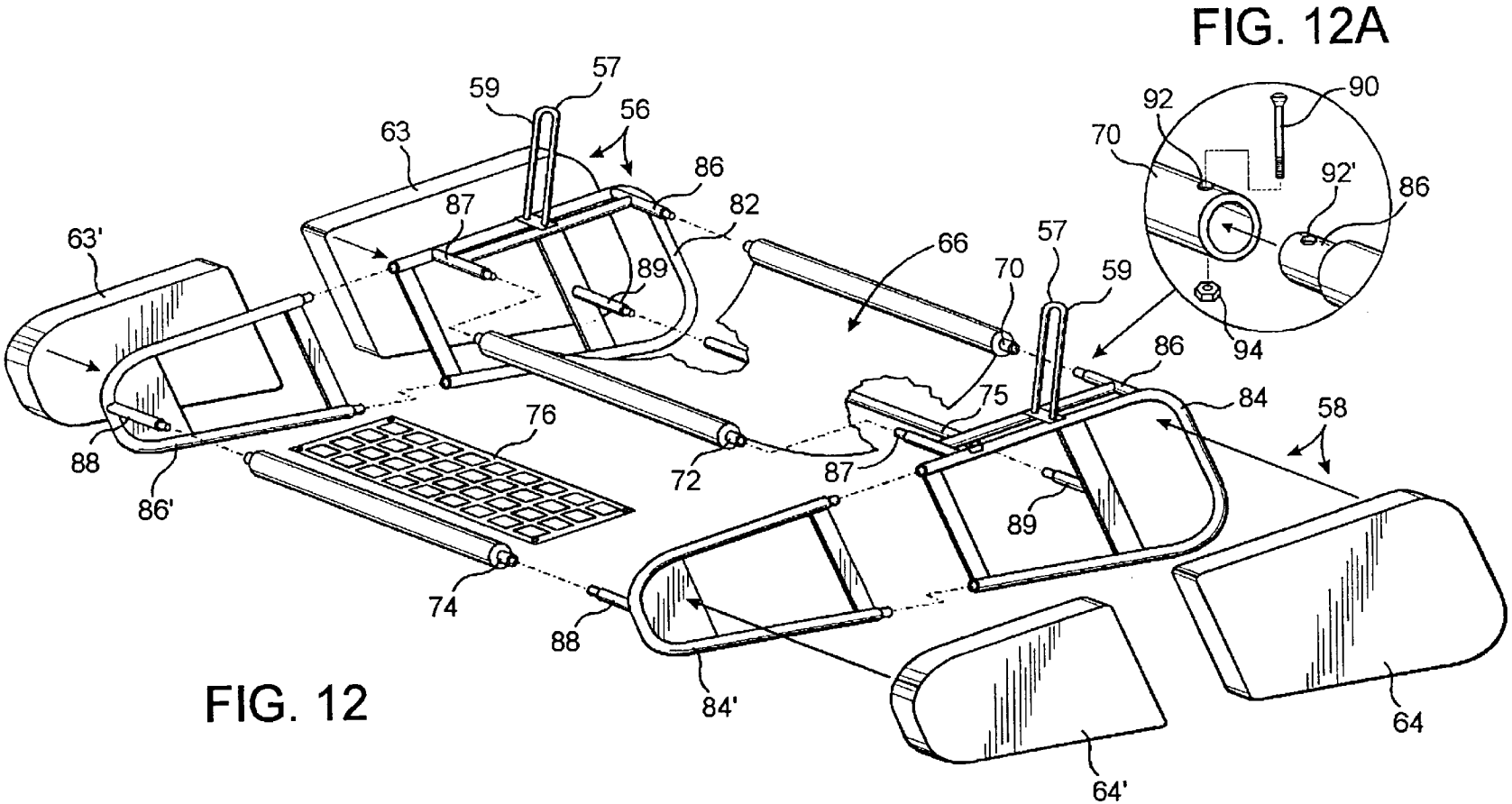
FIG. 12 is an exploded perspective view of a rider support structure in the form of a preferred aerial recliner and seat assembly in accordance with the present invention.
Figure 13:
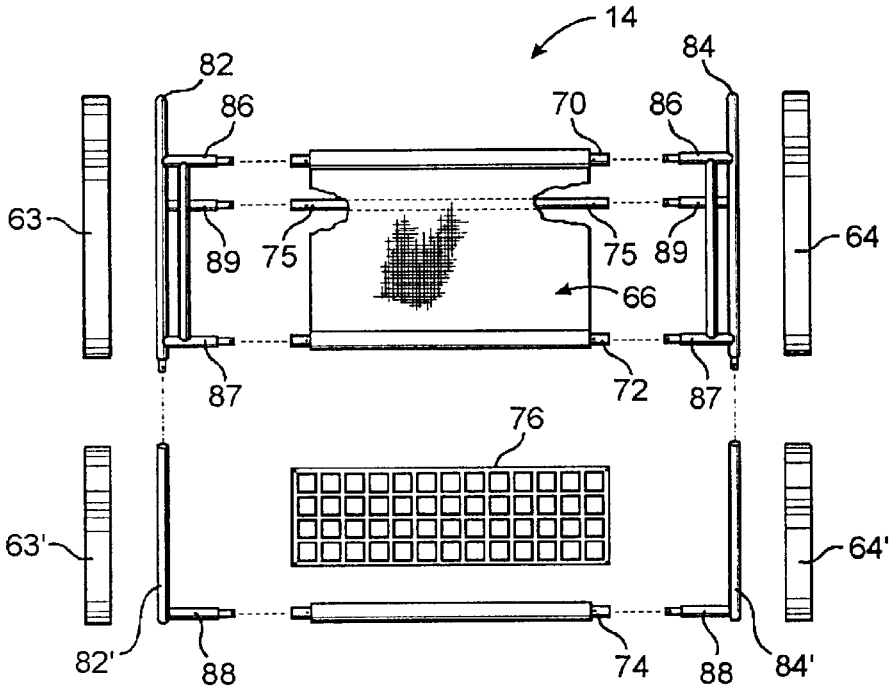
FIG. 13 is a top, exploded view of the rider support structure illustrated in FIG. 12.
Figure 14:
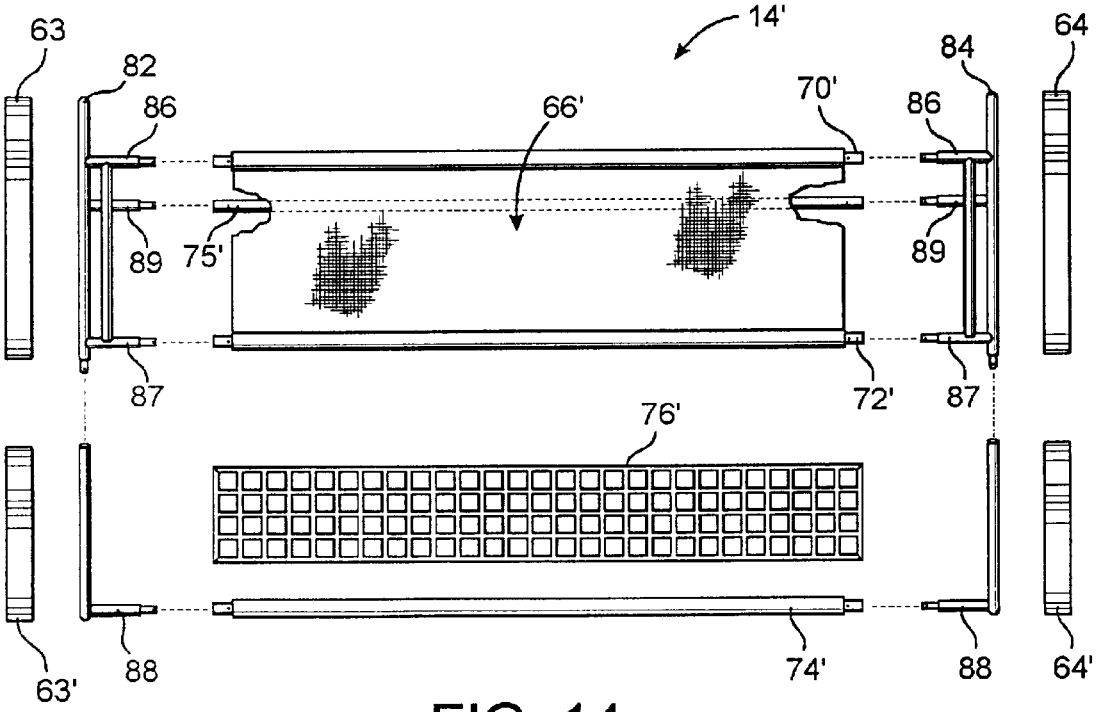
FIG. 14 is a top, exploded view of a rider support structure in an embodiment similar to that illustrated in FIGS. 12 and 13.

Turning now to FIGS. 9 and 10, the present invention is also directed to an improved rider support structure in the form of an aerial recliner and seat assembly, generally indicated as 14, that is capable of being disassembled and reassembled, as needed. As shown in FIGS. 9 and 11, each strap 22 and 24 has its opposite ends 23 and 25 secured to forward and aft end couplings or eyelets 61 and 62. Leading portions 22' and 24' of each strap 22 and 24 are passed through a loop structure 57 of an upwardly extending guide support 59 preferably removably attached to each of the two side wall portions 56 and 58 which comprise a part of the aerial recliner and seat assembly 14. The guide supports 59 engage the leading portion 22' and 24' as shown for the purpose of maintaining flight stability in situations, such as but not limited to, unbalanced or shifting passenger load. In this embodiment, the aerial recliner and seat assembly 14 comprises a support frame which preferably, is defined primarily by two sidewall portions, 56 and 58, a seat portion, 66, and a plurality of brace members, such as 70, 72, 74. Further, a separate float structure, such as 63 and 64, is preferably attached to each of the sidewall portions, 56 and 58, with the float structures, 63 and 64, being formed of a buoyant material or otherwise structured to have a buoyancy which is sufficient to support a plurality of riders on the seat portion 66, such as may become necessary if the aerial recliner and seat assembly 14 were to inadvertently land on the surface of the body of water. Preferably, the seat portion 66, is formed of a flexible material to have a "sling" type of structure, with one end thereof, 67, removably secured to one of the plurality of brace members, such as 70, and an opposite end thereof, 68, secured to a spaced apart, next adjacent, brace member, such as 72. A third of the plurality of brace members, 74, may serve as a foot rest or alternatively, as a support for a netting structure, 76, mounted on the aerial recliner and seat assembly 14, as best shown in FIGS. 12–14. The netting structure 76 may also serve as a foot rest for one or a plurality of passengers retained within seat portion 66 in a somewhat reclined orientation as their legs extends over the second brace member 72. An additional brace member 75, illustrated in FIG. 12, may also be provided in interconnecting relation between sidewall portions 56 and 58 to add structural integrity to the aerial recliner and seat assembly 14. As shown throughout FIGS. 10 through 14, the brace members 70, 72, 74 and 75 are structured and disposed to interconnect sidewall portions 56 and 58 in a manner which provides structural integrity to the overall seat assembly 14. In that vein, each of the brace members 70, 72, 74 and 75 are preferably formed of a high strength metallic material, or other high strength material, and further, are preferably formed so as to be elongated and tubular, with at least partially hollow interiors at their opposite end portions. In addition, the brace members 70, 72, 74, and 75 are preferably disposed in spaced-apart but generally parallel relation when assembled and disposed in interconnecting orientation, as is perhaps best shown in FIGS. 10–14, and are structured to permit their removable interconnection between the sidewall portions 56 and 58.

As described, and with reference to FIGS. 12, 12A, 13, and 14, an inventive feature of the present invention is that the aerial recliner and seat assembly 14 is capable of having its various components selectively attached to one another to permit assembly into an operative parasailing position and/or of having its various components selectively detached from one another to permit a portable position such as for shipping. More specifically, when the plurality of structural components comprising the aerial recliner and seat assembly 14 are detached, they may be arranged in an orientation or format which is well suited to being packaged and shipped in that the overall volume of the assembly 14 has been significantly reduced, which in turn, results in a significant cost savings, from the reduction in the shipping cost, particularly when such rider support structures in the form of the assembly 14 is to be shipped from the United States to various locations throughout the world. Accordingly, it is intended that the seat assembly 14 be initially delivered to the receiving customer in a portable, kit-like configuration, in that many of the various structural components are disassembled. However, the overall design of the structural components of the seat assembly 12 are such as to facilitate quick and easy assembly in a manner which assures safety and structural integrity.

With reference to FIGS. 13 and 14, an additional inventive feature of the present invention relates to the ability of the aerial recliner and seat assembly 14 to have the dimensions of certain ones of its components, particularly the brace members 70, 72, 74 and 75 as well as the seat portion 66, varied. This in turn, allows one in charge of a parasailing business to regulate the amount of riders to be carried at one time by the assembly 14. More specifically, the brace members 70, 72, 74 and 75 may be utilized in varying lengths, having different longitudinal dimensions. It should be emphasized that while each of the tubular structures defining the brace members 70, 72, 74 and 75 have somewhat of a common longitudinal dimension, this common longitudinal dimension may be increased, as shown in FIG. 14, wherein the brace members are respectively indicated as 70', 72', 74' and 76', so as to increase the capacity, and therefore, the number of riders which may be carry by the assembly 14 on any given flight. In that same vein, the preferred sling structure which defines the seat portion 66 may also be changed so as to have a greater longitudinal dimension or corresponding dimension or alternatively, a plurality of the preferred sling structures may be utilized in a connected, side-by-side relation to one another so as to correspond to the increased longitudinal dimension of the brace members 70, 72, 74 and 75.

As best shown in FIGS. 12, 13 and 14, the aerial recliner and seat assembly 14 comprises the two sidewall portions, 56 and 58, each of which includes a support frame 82 and 84, respectively. The support frames 82 and 84 are formed from a high strength material such as a metallic material or a fiberglass material. As has also been indicated, it is preferred that each of the float structures 63 and 64 of sidewall portions 56 and 58 be removably attached to the outer surface of each of the support frames 82 and 84 and be detachable therefrom when, as set forth above, it is desired to disassemble the various components of the seat assembly 14 for a "reduced volume" packaging format. In addition, the inner portions of support frames 82 and 84 may be structured and disposed to include a plurality of outwardly extending mounting members, as at 86, 87, 88 and 89. In such an embodiment, the outwardly extending members 86–89 will preferably be formed to be stub ends that are specifically dimensioned so as to fit generally within the interior of the opposite, open hollow ends of the various brace members 70, 72, 74 and 75, respectively, which, as set forth above, are defined by a hollow, tubular configuration. Referring to the isolated, magnified illustration within FIG. 12A, it is pointed out that once the plurality of brace members are disposed in their interconnected, operative position as represented in FIGS. 9, 10, and 11, this position may be safely maintained by bolts 90, or like connectors, being passed through appropriately positioned, aligned apertures, such as 92 and 92' formed in both of the opposite ends of each of the brace members 70, 72, 74 and 75, and the appropriately positioned and corresponding, interlocking stub ends 86, 87, 88 and 89, respectively. The preferred sling structure and flexible material from which the seat portion 66 is formed may, as a preliminary step, be slid over the spaced-apart but adjacently positioned brace members 70 and 72.

As further shown in FIGS. 12 through 14, the ability of the aerial recliner and seat assembly 14 of the present invention to be disassembled for reduced volume packaging is facilitated by the transverse separation of components of sidewall portions 56 and 58. More specifically, in one preferred embodiment, the sidewall portions 56 and 58 include support frames 82 and 84 being separable into components 84, 84' and 86, 86' respectively, and further, float structures, 63 and 64, are separable into components 63, 63' and 64, 64' respectively.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A parasailing assembly for suspending a rider from an air filled parachute being towed by a boat; said assembly comprising:

a) a rider support structure supportingly engaging the rider, b) a connecting assembly disposed in interconnecting relation between said rider support structure and the parachute, c) said connecting assembly including two straps, each having an elongated configuration terminating in opposites ends, d) said connecting assembly further including a first and a second plurality of riser lines sets each disposed in interconnecting relation between the parachute and a different one of said two straps, e) each of said first and second plurality of riser line sets comprising a base portion defined by a common area of attachment of corresponding ones of said riser line sets, f) each of said two straps comprising an inter connecting link disposed thereon intermediate said opposite ends thereof, each of said interconnecting links being correspondingly disposed on respective once of said two straps and defining a single fulcrum point along the length of respective once of said two straps, and g) each of said interconnecting links being connected to said base portion of a different one of said first and second plurality of riser lines sets.

2. A parasailing assembly designed to suspend a rider from an air filled parachute being towed by a boat, said assembly comprising:

a) a rider support structure to supportingly engaging the rider, b) a connecting assembly disposed in interconnecting relation between said rider support structure and riser lines of the parachute, c) said connecting assembly including at least two straps, each having an elongated configuration and terminating in opposite ends, with as least one pair of opposite ends being coupled to said rider support structure, d) a base portion connected to each of said at least two straps intermediate said opposite ends thereof, with said base portion defining a common area of attachment for separate groupings of said riser lines.

3. An assembly as recited in claim 2 wherein said rider support structure comprises a seat assembly structured to support one or more riders in a substantially seated orientation thereon.

4. An assembly as recited in claim 3 wherein said seat assembly is structured to be selectively arranged in an assembled, operative orientation or a disassembled orientation for packaging and shipping.

5. An assembly as recited in claim 4 wherein said seat assembly comprises a float assembly formed of a material having sufficient buoyancy to support and maintain said seat assembly and the one or more riders thereon on the surface of a body of water.

6. An assembly as recited in claim 5 wherein said seat assembly comprises a seat portion dimensioned and configured to retain a plurality of riders thereon in an at least partially reclined orientation.

7. An assembly as recited in claim 4 wherein said rider support structure further comprises a frame including two sidewall portions disposed in spaced relation to one another and a plurality of brace members removably attached in interconnecting relation to said side wall portions.

8. An assembly as recited in claim 7 wherein said seat assembly further comprises a float structure mounted on each of said two side wall portions and formed of a buoyant material.

9. An assembly as recited in claim 7 wherein said seat assembly further comprises a seat portion removably mounted in supported relation on said plurality of brace members, said seat portion being further dimensioned and configured to retain at least one rider thereon.

10. An assembly as recited in claim 9 wherein said disassembled orientation is at least partially defined by said side wall portions, said plurality of brace members and said seat portion being disposed in detached relation to one another.

11. An assembly as recited in claim 9 wherein said plurality of brace members are of substantially common length defined by a longitudinal dimension that is variable to facilitate regulation of an overall transverse dimension of said support frame.

12. An assembly as recited in claim 11 wherein said seat portion may include a variable transverse dimension dependent on the longitudinal dimension of said plurality brace members so as to regulate the number of riders capable of being retained in said seat portion.

13. An assembly as recited in claim 12 wherein said seat portion comprises a sling structure formed of a flexible material and removably attached at substantially opposite ends thereof to spaced apart ones of said plurality of brace members.

14. An assembly as recited in claim 7 wherein said opposite ends of each of said two straps comprise a leading end and a trailing end; and further wherein said leading end and said trailing end of each strap are removably attached to a forward end and an aft end, respectively, of a different one of said two sidewall portions.

15. An assembly as recited in claim 2 wherein said rider support structure comprises a body harness.

16. An assembly as recited in claim 15 wherein said opposite ends of each of said at least two straps comprise a leading end and a trailing end, and further wherein said trailing end of each strap is removably connected to said body harness and said leading end of each strap is removably connected to a tow line extending from the boat.

17. An assembly as recited in claim 16 wherein each of said trailing ends are removably connected to said body harness at spaced apart locations, substantially on opposite sides of said body harness; and wherein each of said leading ends are removably connected to the tow line at a substantially common location.

18. An assembly as recited in claim 2 wherein said rider support structure comprises a seat assembly or alternatively a body harness.

19. An assembly as recited in claim 2 wherein each of said two straps comprises an interconnecting link disposed thereon intermediate said opposite ends thereof; and wherein each of said interconnecting links are connecting to one of said base portions.

20. An assembly as recited in claim 19 wherein each of said interconnecting links defines a single fulcrum point along the length of respective ones of said two straps.

21. An assembly as recited in claim 20 wherein said interconnecting links are correspondingly disposed on respective ones of said two straps.

22. An assembly as recited in claim 20 wherein each of said interconnecting links are fixedly connected to said base portion.

23. An assembly as recited in claim 20 wherein each of said interconnecting links is removably connected to said base portion of a different one of said first and second plurality of riser line sets.

24. A parasailing assembly for suspending a rider from an air filled parachute being towed by a boat, said assembly comprising:

a) a rider support structure supportingly engaging the rider thereon, b) a connecting assembly disposed in interconnecting relation between said rider support structure and riser lines of the parachute, c) said rider support structure comprising a seat assembly structured to support at least one rider thereon and including a plurality of brace members, d) said rider support structure further including two spaced apart sidewall portions each including a support frame; said plurality of brace members removably attached in interconnecting relation to said support frames, e) each of said sidewall portions including a float structure formed of buoyant material and mounted on corresponding ones of said support frames, f) said seat assembly further comprising a seat portion removably mounted in supported relation on said plurality of brace members, g) said rider support being structured to facilitate an assembled orientation and a disassembled orientation;

h) said assembled orientation defined by operative attachment and interconnection of said two sidewall portions, said plurality of brace members and said seat portion; and i) said disassembled orientation defined by detachment of said two sidewall portions, said plurality of brace members and said seat portion to facilitate reduced volume packaging and shipping of said rider support structure.

25. An assembly as recited in claim 24 wherein said connecting assembly includes two straps each having an elongated configuration and terminating at opposite ends and a first and second plurality of riser line sets each disposed in interconnecting relation between the parachute and a different one of said two straps; each of said first and second plurality of riser line sets comprising a base portion defined by a common area of attachment of corresponding ones of said riser line sets; each of said base portions connected to a different one of said two, straps at a single fulcrum point disposed intermediate said opposite ends of respective ones of said two straps.

* * * * *